US006953646B2

(12) United States Patent
Doujo et al.

(10) Patent No.: US 6,953,646 B2
(45) Date of Patent: Oct. 11, 2005

(54) TONER PARTICLES INCLUDING A SULFUR-CONTAINING RESIN

(75) Inventors: Tadashi Doujo, Shizuoka (JP); Yuichi Mizoh, Ibaraki (JP); Nene Shibayama, Shizuoka (JP); Yusuke Hasegawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 10/437,021

(22) Filed: May 14, 2003

(65) Prior Publication Data

US 2004/0013962 A1 Jan. 22, 2004

(30) Foreign Application Priority Data

May 14, 2002 (JP) ..... 2002-138400

(51) Int. Cl.[7] ..... G03G 9/097

(52) U.S. Cl. ..... 430/108.22; 430/108.5; 430/106.1

(58) Field of Search ..... 430/106.1, 108.22, 430/108.5

(56) References Cited

U.S. PATENT DOCUMENTS

| | | | | |
|---|---|---|---|---|
| 5,483,327 | A | 1/1996 | Taya et al. | 355/245 |
| 5,695,902 | A | 12/1997 | Mikuriya et al. | 430/110 |
| 5,773,183 | A | 6/1998 | Doujo et al. | 430/106 |
| 5,976,752 | A | 11/1999 | Matsunaga et al. | 430/110 |
| 6,040,103 | A | 3/2000 | Ohno et al. | 430/110 |
| 6,232,027 | B1 | 5/2001 | Matsunaga et al. | 430/109 |
| 2002/0045120 | A1 | 4/2002 | Yoshikawa et al. | 430/108.5 |
| 2002/0072006 | A1 * | 6/2002 | Mizoo et al. | 430/108.22 |

FOREIGN PATENT DOCUMENTS

| | | |
|---|---|---|
| JP | 63184762 | 7/1988 |
| JP | 3161761 | 7/1991 |
| JP | 5142853 | 6/1993 |

* cited by examiner

*Primary Examiner*—Christopher Rodee
(74) *Attorney, Agent, or Firm*—Fitzpatrick, Cella, Harper & Scinto

(57) ABSTRACT

A toner comprises toner particles comprising at least a binder resin, a colorant, and a sulfur-containing resin, in which the toner particles comprise the sulfur-containing resin so as to satisfy a relation of; $0.50 \leqq I_S/T_S \leqq 0.95$ where $T_S$ denotes a content of sulfur in the toner particles, and $I_S$ denotes a content of sulfur in isopropyl alcohol insoluble components of the toner particles, whereby it is possible to obtain a high quality image having an excellent developing resistance regardless of the surrounding conditions and a uniform charge amount distribution regardless of processing speed.

14 Claims, No Drawings

TONER PARTICLES INCLUDING A SULFUR-CONTAINING RESIN

This application claims the right of priority under 35 U.S.C. §119 based on Japanese Patent Application No. JP 2002-138400 which is hereby incorporated by reference herein in its entirety as if fully set forth herein.

BACKGROUND OF THE INVENTION

1. Field of the Invention

The present invention relates to a toner used in a recording method that utilizes an electrophotographic process, an electrostatic recording process, an electrostatic printing process, and a toner-jet recording process.

2. Description of the Related Art

Heretofore, an electrophotographic process has been known as one that obtains a toner image by forming an electric latent image on a photosensitive member by various means utilizing a photoconductive material and subsequently developing the latent image with toner, followed by optionally transferring the toner image to a transfer member such as paper, and fixing the toner image on the paper by the action of heat, pressure, both of heat and pressure, or solvent vapor. In recent years, the image qualities of copies and printed images have been demanded much better than before as the digitalization of copying machines and printers has progressed. Based on such a demand, for improving the reproducibility of dot, there is a need of making toner into finer particles than before. Making toner into fine particles is effective for improving resolving paper or sharpness of an image, but may occur various kinds of problems.

For instance, the surface area of the toner increases when the particle size of toner is made small. As a result, the width of charge amount distribution increases, so that fogging that the toner is developed on a non-image portion would be easily caused. In addition, the charge characteristics of the toner become more susceptive to an influence of the surroundings. Also, an attempt has been made to make a sharp distribution of particle sizes for decreasing the fog or the like. However, such an attempt becomes a cause of increasing the manufacturing cost of toner. In additions such an attempt causes the performance of toner to be further affected according to whether the dispersibility of a binder resin and other internal additives is good or bad. With regard to such problems, as a method of providing the toner with desired frictional charge characteristics, the addition of a charge control agent into the toner has been known.

So far, the following charge control agents have been known in the art. That is, negative frictional charge control agents such as metallic complex salt of mono-azo dye, and metallic complex salt of hydroxy-dicarboxylic acid, dicarboxylic acid, and aromatic diol; and a positive frictional charge control agents such as nigrosine dye, azine dye, triphenylmethane-based dyes and pigments, quaternary ammonium salt, and polymers having quaternary ammonium salts on the side chains thereof. However, most of these charge control agents are being colored, so that most of them cannot be used in color toner. Furthermore, depending on the charge control agent, there are several problems with respect to the application to toner, such as difficulty in adjusting the image density and the degree of fogging in balance, difficulty in obtaining sufficient image density under high-temperature and high-humidity conditions, poor dispersibility to a resin, and adverse effects to storage stability, fixability, and offset resistance.

In recent years, in terms of the frictional charge control and the safety, a charge control resin has been also studied.

For the toner for which such a charge control resin is used, for example, a method is disclosed in JP 63-184762 A, in which a polymer of styrene monomer and 2-acrylamide-2-methylpropanesulfonic acid is used as-a charge control agent. In addition, JP 3-161761 A and JP 5-142853 A disclose a method which a polymer of styrene monomer and 2-acrylamide-2-methylpropane sulfonic acid is used as a charge control agent to a polyester resin. According to these methods, the resulting toner is described as one having excellent optical characteristics and charge characteristics.

However, each of the methods described above has a problem in that the method cannot realize a stable developing performance irrespective of the usage situation, because such a problem is caused as the characteristics of a toner tend to vary depending on the factors of environmental variation, change with time, or the like when applied according to a desired image-forming process, as in the case of making the toner into finer particles or adopting a one-component developing system for attaining a high image quality.

SUMMARY OF THE INVENTION

An object of the present invention is to provide a toner with which the above-mentioned problems are solved, and which can realize a high quality image, an excellent developing-resistance performance regardless of the surrounding conditions, and a uniform charge amount distribution regardless of processing speed.

The present invention relates to a toner comprising toner particles comprising at least a binder resin, a colorant, and a sulfur-containing resin, in which:

the toner particles comprise the sulfur-containing resin so as to satisfy a relation of:

$$0.50 \leqq I_S/T_S \leqq 0.95$$

where $T_S$ denotes a content of sulfur in the toner particles, and $I_S$ denotes a content of sulfur in isopropyl alcohol insoluble components of the toner particles.

DETAILED DESCRIPTION OF INVENTION

The inventors of the present invention have made detailed studies and found out a correlation between charge characteristics of toner and an amount of a sulfur-containing resin in toner particles and also in components which are insoluble in isopropyl alcohol (IPA) in the toner particles (hereinafter, such components are referred to as IPA-insoluble components).

It is known that the charge characteristics of the toner are extremely affected by effects of a charge control agent presents near the surface of the toner. In addition, isopropyl alcohol has moderate solubility to the sulfur-containing resin, so that it can be an appropriate solvent to extract low molecular weight components. On the other hand, components which are soluble in isopropyl alcohol in the sulfur-containing resin (hereinafter, such components are referred to as IPA-soluble components) is one having a comparatively low molecular weight, so that the percentage of the components present near the surface of toner particles is high. Therefore, the above correlation is considered as being attained due to a matter that the charge of toner can be easily adjusted by appropriately comprising a sulfur-containing component that exerts an effect in charge control into the low molecular weight components in the sulfur-containing resin.

The toner of the present invention comprises toner particles that comprise at least a binder resin, a colorant, and a sulfur-containing resin. In which the toner particles satisfy the relation of:

$$0.50 \leqq I_S/T_S \leqq 0.95$$

where $T_S$ denotes the content of sulfur in the toner particles and $I_S$ denotes the content of sulfur in the IPA-insoluble components.

In the present invention, the ratio of $I_S/T_S$, i.e., the ratio of the content of sulfur ($I_S$) in the IPA-insoluble components to the content of sulfur ($T_S$) in the toner particles is 0.95 or less, preferably 0.85 or less. If it is more than 0.95, the effect of charge control decreases as the amount of the sulfur-containing component present on the surface of the toner particles decreases. As a result, the developing performance of the toner may be largely changed by environmental variation. When an excess amount of the sulfur-containing resin is added for increasing the amount of the sulfur-containing resin on the surface of the toner particles, the fixability of the toner becomes deteriorated and the dispersibility of the resin to other internal additive is also affected. In this case, therefore, harmful effects may occur to the charge characteristics of the toner.

Furthermore, in the present invention, the ratio $I_S/T_S$ is 0.50 or more, preferably 0.60 or more. If the ratio $I_S/T_S$ is less than 0.5, the distribution of the sulfur-containing component in the toner particles is localized on the surface, so that the dispersion of the sulfur-containing component in the toner particles with a resin, a colorant, and so on becomes worse extremely. As a result, the charge amount distribution of the toner becomes broadened, so that a high-quality image may be hardly obtained. In this case, furthermore, the solubility to water also increases, so that defective charging may easily occur in high-humidity environments.

Furthermore, the toner of the present invention may preferably comprise 0.1 to 10% by mass of IPA-soluble components in toner particles. If the content of the IPA-soluble components is less than 0.1% by mass, the charge control effect of the sulfur-containing resin may be decreased. On the other hand, if the content of the IPA-soluble components is more than 10% by mass, the hygroscopic properties of the toner increase, so that the charge characteristics of the toner may be deteriorated at high humidity.

In the present invention, it is possible to adjust the above $I_S$ and $T_S$ properly according to the blending amount of the sulfur-containing resin to be blended in the toner particles, the weight average molecular weight of the sulfur-containing resin, the type of monomer of the sulfur-containing resin, polymerization conditions, and so on. It is also possible to adjust the amount of the IPA-soluble components properly according to the raw material of toner particles, the manufacturing conditions of toner particles, and so on.

The binder resins to be applicable to the present invention include polyester resin, styrene-acrylic resin, hybrid resin containing polyester resin component and styrene-acrylic resin component, epoxy resin, styrene-butadiene resin, polyurethane resin, and so on. However, the present invention is not particularly limited to these resins. Alternatively, any of the resins well known in the art can be used. Among them, in particular, the polyester resin, hybrid resin, and so on are preferable because of afixability, and so on of the toner.

The above polyester resin is one generated by a polycondensation between polyhydric alcohol and polybasic acid. Monomers to be applicable as a polyester resin component include the following compounds.

As the dihydric alcohol component, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, a hydrogenated bisphenol A, a bisphenol derivative represented by the following formula (I), or diols represented by the following formula (II) can be given.

(I)

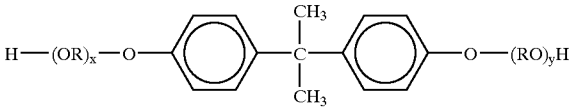

(wherein R represents an ethylene or a propylene group, each of x and y is an integer of 1 or more, and an average of x+y is 2 to 10)

(II)

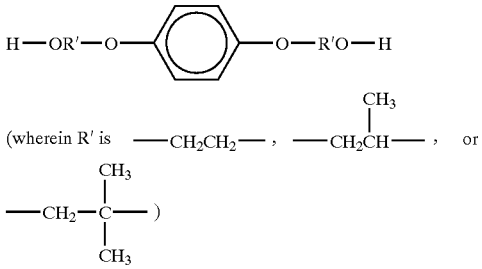

Further, as the divalent carboxylic acid, for example, benzenedicarboxylic acids and anhydrides thereof such as phthalic acid, terephthalic acid, isophthalic acid, and phthalic anhydride; alkyldicarboxylic acids and anhydrides thereof such as succinic acid, adipic acid, sebacic acid, and azelaic acid: and further, succinic acids substituted by an alkyl group having 6 to 18 carbon atoms, and anhydrides thereof; unsaturated dicarboxylic acids and anhydrides thereof such as fumaric acid, maleic acid, citraconic acid, and itaconic acid can be given.

Further, as other monomers of the polyester resin, for example, polyhydric alcohols such as glycerin, pentaerythritol, sorbitol, sorbitan, and further, polyhydric alcohols of oxyalkylene ether of novolak type phenol resins; and polyvalent carboxylic acids such as trimellitic acid, pyromellitic acid, and benzophenonetetracarboxylic acid, and anhydrides thereof can be given.

The above styrene-acrylic resins are resins produced by addition polymerization of styrene type monomers and acrylic monomers. Examples of the vinyl type monomers used to produce the styrene-acrylic resins are given below.

As the styrene type monomers, styrene and derivatives thereof such as styrene, o-methylstyrene, m-methylstyrene, p-methylstyrene, p-phenylstyrene, and p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene can be given.

Further, as the acrylic monomers, for example, acrylic acid and acrylates such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylates; a-methylene aliphatic monocarboxylic acids and esters thereof, such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; derivatives of acrylic acid or metacrylic acid such as acrylonitrile, methacrylonitrile, and acrylamide can be given.

Further, as the monomers of styrene-acrylic resins, acrylates or methacrylates such as 2-hydroxylethyl acrylate, 2-hydroxylethyl methacrylate, and 2-hydroxylpropyl methacrylate, and monomers with hydroxyl groups such as 4-(1-hydroxy-1-methylbutyl)styrene and 4-(1-hydroxy-1-methylhexyl)styrene can be given.

Further, in styrene-acrylic resins, if required, it is possible to use in combination various monomers with which vinyl polymerization is possible. As examples of these kinds of monomers, monoolefins such as ethylene, propylene, butylene, and isobutylene, unsaturated polyenes such as butadiene, and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, and vinyl hexyl ketone, and methyl isopropenyl ketone; N-vinyl compounds such as N-vinylpyrrole, N-vinylcarbazole, N-vinylindole, and N-vinylpyrrolidone; vinylnaphthalins; and further, unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride, unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid ester such as dimethyl maleate, and dimethyl fumarate; acid anhydride of a, B-unsaturated acids such as acrylic acid, methacrylic acid, crotonic acid, and cinnamic acid; anhydrides of the above-mentioned a, B-unsaturated acids and lower aliphatic acids; monomers with a carboxyl group such as alkenylmalonic acid, alkenylglutaric acid, and alkenyladipic acid, and acid anhydrides thereof and monoesters thereof can be given.

The above styrene-acrylic resin may be a polymer cross-linked with a cross-linkable monomer exemplified as follows in case of necessity. The cross-linkable monomers include, for example, aromatic divinyl compounds, diacrylate compounds bonded with alkyl chains, diacrylate compounds bonded with alkyl chains including ether bonds, diacrylate compounds bonded with chains including aromatic groups and ether bonds, diacrylate compounds bonded with chains including aromatic groups and ether bonds, polyester-type diacrylates, and polyfunctional cross-linking agents.

As the aromatic divinyl compounds, for example, divinylbenzene, divinylnaphthalene, etc. may be given.

As the diacrylate compounds bonded with an alkyl chains, for example, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, those obtained by changing the "acrylate" of the aforementioned compounds to "methacrylate", etc. may be given.

As the diacrylate compounds bonded together with an alkyl chains including ether bonds, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, those obtained by changing the "acrylate" of the aforementioned compounds to "methacrylate", etc. may be given.

As the diacrylate compounds bonded with chains including aromatic groups and ether bonds, for example, polyoxyethylene(2)-2,2-bis(4-hydroxyphenyl)propane diacrylate, polyoxyethylene(4)-2,2-bis(4-hydroxyphenyl) propane diacrylate, those obtained by changing the "acrylate" of the aforementioned compounds to "methacrylate", etc. may be given.

As the polyester-type diacrylates, for example, trade name MANDA manufactured by Nippon Kayaku Co., Ltd. can be given.

As the polyfunctional crosslinking agents, pentaerythritol triacrylate, trimethylolethane triacrylate, trimethylolpropane triacrylate, tetramethylolmethane tetraacrylate, oligoester acrylate, and those obtained by changing the "acrylate" of the aforementioned compounds to "methacrylate", triallyl cyanurate, triallyl trimellitate, etc. can be given.

Those cross-linkable monomers may be used at a concentration of 0.01 to 10% by weight, (more preferably 0.03 to 5% by weight) with respect to 100% by weight of other monomer components. Further, of those cross-linkable monomers, aromatic divinyl compounds (particularly, divinylbenzene) and diacrylate compounds bonded with chains including aromatic groups and an ether bonds are preferably used in terms of the fixability and offset resistance.

Further, the aforementioned styrene-acrylic resins may be a resin produced by using a polymerization initiator. As these types of polymerization initiators, for example, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, a,a'-bis(t-butylperoxyisopropyl)benzene isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxydicarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate can be given.

The hybrid resin described above is a resin obtained through the chemical bond between the polyester resin component and the styrene-acrylic resin component in a direct or indirect manner, which includes the polyester resin component and the styrene-acrylic resin component, and a monomer component which can be reacted with both the resin components.

Among the monomers that constitute the polyester resin components, for example, the monomers reactable with the styrene-acrylic resin component include unsaturated dicarboxylic acids such as fumaric acid, maleic acid, citraconic acid, and itaconic acid, or anhydrates thereof.

Among monomers that constitute the styrene-acrylic resin component, those reactable with the polyester resin component include, for example, monomers having carboxyl groups or hydroxyl groups, and acrylic esters and methacrylic esters.

As a preferable method of obtaining the above hybrid resin, a polymerization reaction of one or both of the polyester resin and the styrene-acrylic resin is performed in the presence of a polymer that contains a monomer component which can react with each of these resins.

The above sulfur-containing resin generally has the property of acting as a charge control agent in toner particles, so that the sulfur-containing resin would be mainly added as a charge control agent in the present invention. Therefore, the sulfur-containing resin is preferably a polymer having sulfonic acid group or a copolymer thereof in terms of charge control. In other words, it is preferable that the sulfur-containing resin mainly contain a monomer that contains sulfonic acid group. More preferably, the sulfur-containing resin, is a sulfur-containing polymer or copolymer mainly containing an acrylamide monomer that contains sulfonic acid group as a constituent.

As the acrylamide monomer containing sulfonic acid group, 2-acrylamidepropanesulfonic acid, 2-acrylamide-n-butanesulfonic acid, 2-acrylamide-n-hexanesulfonic acid, 2-acrylamide-n-octanesulfonic acid, 2-acrylamide-n-dodecanesulfonic acid, 2-acrylamide-n-tetradecanesulfonic acid, 2-acrylamide-2-methylpropanesulfonic acid, 2-acrylamide-2-phenylpropanesulfonic acid, 2-acrylamide-2,2,4-trimethylpentanesulfonic acid, 2-acrylamide-2-methylphenylethanesulfonic acid, 2-acrylamide-2-(4-chlorophenyl)propanesulfonic acid, 2-acrylamide-2-carboxymethylpropanesulfonic acid, 2-acrylamide-2-(2-pyridyl)propanesulfonic acid, 2-acrylamide-1-methylpropanesulfonic acid, 3-acrylamide-3-methylbutanesulfonic acid, 2-methacrylamide-n-decanesulfonic acid, 2-methacrylamide-n-tetradecanesulfonic acid, etc. can be given. Preferably, 2-acrylamide-2-methylpropanesulfonic acid is given.

The sulfur-containing resin to be used in the present invention is preferably a copolymer mainly containing: the above acrylamide monomer containing sulfonic acid group; and at least one of the styrene monomer and the acrylic monomer in terms of the charge characteristic and the molecular weight adjustment. The styrene monomer and the acrylic monomer are appropriately selected from monomers for the preparation of the above styrene-acrylic resin. Preferably, a combination of styrene and acrylic ester or metacrylic ester is used.

A method of synthesizing the sulfur-containing resin is not specifically limited. Any of solution polymerization, suspension polymerization, bulk polymerization, and so on may be applicable. Among them, however, it is preferable to use the solution polymerization in which the polymerization proceeds in an organic solvent that contains lower alcohol. A polymerization initiator to be used for the synthesis of the sulfur-containing resin is appropriately selected from polymerization initiators to be used for the preparation of the above styrene-acrylic resin. Preferably, a peroxide polymerization initiator is used.

In the sulfur-containing resin to be used in the present invention, a large amount of sulfur-containing monomer is preferably comprised in a low molecular weight component for an appropriate existence of the sulfur-containing component effective for charge control on the surface of toner particles. If such a sulfur-containing monomer is used as a constituent, the solubility of the sulfur-containing monomer to lower alcohol is comparatively increased when the above solution polymerization is applied. Therefore, by appropriately adjusting the polymerization solvent or the other polymerizable composition, or the polymerization conditions, it becomes possible to allow the sulfur-containing component to exist as appropriate near the surface of toner particles.

In the present invention, the relationship between the content of sulfur $B_S$ in the sulfur-containing resin and the content of sulfur $IB_S$ in the IPA-Insoluble components of the sulfur-containing resin is preferably represented by the expression: $0.5 \leqq IB_S/B_S \leqq 0.95$, more preferably represented by the expression: $0.60 \leqq IB_S/B_S \leqq 0.85$. When the ratio of the contents of sulfur in the sulfur-containing resin is in the above range, the amount of the sulfur-containing component on the surface of toner particles can be easily adjusted.

The sulfur-containing resin to be used in the present invention is preferably a polymer having a weight average molecular weight in the range of 5,000 to 50,000. If the weight average molecular weight is less than 5,000, the hygroscopic properties of the sulfur-containing resin tend to increase as a result of an increase in the content of the IPA-soluble components. Furthermore, if the weight average molecular weight is more than 50,000, the content of the IPA-soluble components decreases. As a result, the effect of charge control decreases while the dispersibility of the sulfur-containing resin and the binder resin becomes deteriorated, so that stable charge characteristics may be difficult to achieve when environmental variations and variations with time occur by making the toner particles finer. The weight average molecular weight of the sulfur-containing resin is more preferably in the range of 12,000 to 40,000 for achieving uniform and stable charge characteristics of individual or whole toner particles. The weight average molecular weight of the sulfur-containing resin can be adjusted by the type of monomer, the type of polymerization initiator, polymerization conditions, and so on.

For the charge control, it is preferable that the content of the sulfur-containing resin to be used in the present invention be in the range of 0.2 to 10 parts by mass with respect to 100 parts by mass of the binder resin.

The colorant to be used in the present invention may include one or more kinds of pigments and dyes, such as carbon black, titanium white, and magnetic iron oxide, which have been generally known in the art. The colorant is appropriately selected depending on the type of the toner.

For example, when using a magnetic color toner for the toner of the present invention, as the dye, C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, C.I. Basic Green 6, etc. can be given As for the pigment, Chrome Yellow, Cadmium Yellow, Mineral Fast Yellow, Navel Yellow, Naphthol Yellow-S, Hansa Yellow G, Permanent Yellow NCG, Tartrazine Lake, Orange Chrome Yellow, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Purple, Fast Violet B, Methyl Violet Lake, Prussian Blue, Cobalt Blue, Alkali Blue Lake, Victoria Blue Lake, Phthalocyanine Blue, Fast Sky Blue, Indanthrene Blue BC, Chrome Green, Chrome Oxide, Pigment Green B, Malachite Green Lake, Final Yellow Green G, etc. can be given.

Further when using a two-component full color toner for the toner of the present invention, for example, the following colorants can be given.

As for the coloring pigments for magenta, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet Red 19, C.I. Vat Red 1, 2, 10, 13, 15, 23, 29, 35, etc. can be given.

Although the pigment may be used independently as the colorant, it is more preferable to combine the dye and the pigment to improve definition of an image, from the view of image quality of a full color image. As the dye for magenta, oil soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28 can be given.

As for other coloring pigments, as the coloring pigments for cyan, C.I. Pigment Blue 2, 3, 15, 16, 17, C.I. Vat Blue 6, C.I. Acid Blue 45, and a copper phthalocyanine pigment which has 1 to 5 phthalimidemethyl groups bonding phthalocyanine skeleton as represented by the following formula etc. can be given.

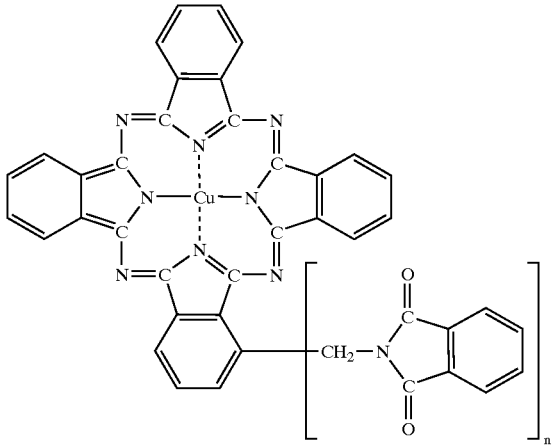

n = 1~5

As for the coloring pigments for yellow, C.I. Pigment Yellow 1, 2, 3, 4, 5, 6, 7, 10, 11, 12, 13, 14, 15, 16, 17, 23, 65, 73, 83, C.I. Vat yellow 1, 3, 20, etc. can be given.

Furthermore, the usage amount of the colorant in the toner of the present Invention varies depending on the type of the colorant. In general, the usage amount of the colorant is in the range of 0.1 to 60 parts by mass, preferably of 0.5 to 50 parts by mass with respect to 100 parts by mass of the binder resin.

When a magnetic toner is used as the toner of the present invention, one of magnetic materials conventionally known in the art is used. The magnetic materials to be contained in the magnetic toner include iron oxides such as magnetite, maghemite, and ferrite, and iron oxides including other metal oxides; metals such as Fe, Co, and Ni, or alloys of these metals with other metals such as Al, Co, Cu, Pb, Mg, Ni, Sn, Zn, Sb, Be, Bi, Cd, Ca, Mn, Se, Ti, W, and V; and mixtures thereof.

Conventionally, furthermore, the well-known magnetic materials include triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel Iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and so on. In the present invention, one or more kinds of materials selected from the magnetic materials listed above may be used arbitrarily.

Preferably, each of the magnetic materials has an average particle size of about 0.1 to 2.0 $\mu$m and magnetic characteristics at an application of 795.8 kA/m (10 k oersted) in which a coercive force is 1.5 kA/m to 12 kA/m, a saturation magnetization is 50 to 200 $Am^2/kg$ (preferably, 50 to 100 $Am^2/kg$), and a residual magnetization is 2 to 20 $Am^2/kg$. The magnetic characteristics of the magnetic material can be measured using a vibration type magnetometer, such as VSM P-1-10 (manufactured by TOEI INDUSTRY Co., Ltd.), under the conditions of an external magnetic field of 769 kA/m at 25° C.

In the case of using as the toner of the present invention a magnetic toner, it is preferable to use magnetic iron oxide as a colorant. Such magnetic iron oxide may be fine powders of, for example, triiron tetroxide or $\gamma$-iron sesquioxide. Furthermore, the content of the magnetic iron oxide in the-toner particles is preferably in the range of 20 to 150 parts by mass with respect to 100 parts by mass of the binder resin in order that the magnetic property is attained such that the toner is prevented from being scattered, while retaining the fluidities of the toner particles, and sufficient coloring is expressed.

Furthermore, in the present invention, the colorant may be surface-hydrophobicized with an appropriate surface-hydrophobicizing agent depending on the desired physical properties of the toner, the manufacturing conditions of the toner particles, and so on.

In the present invention, other additives may be added in the toner particles as the need arises. For such additives, various kinds of additives can be used, which have been conventionally known as additives to be internally added to the toner particles, such as a mold-releasing agent and a charge control agent.

Preferable compounds to be useful as the mold-releasing agent include, for example, aliphatic hydrocarbon waxes such as low molecular weight polyethylene, low molecular weight polypropylene, microcrystalline wax, and paraffin wax; oxides of aliphatic hydrocarbon waxes such as oxidized polyethylene wax and block copolymers thereof; waxes mainly containing fatty acid ester, such as carnauba wax, sasol wax, and montanic acid ester wax; products obtained by partially or entirely deoxidizing fatty acid esters, such as deoxidized carnauba wax; saturated straight fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as linoleic amide, oleic amide, and lauric amide; saturated fatty acid bisamides such as methylene bisstearic amide, ethylene biscapric amide, ethylene bislauric amide, and hexamethylene bisstearic amide; unsaturated fatty acid amides such as ethylene bisoleic amide, hexamethylene bisoleic amide, N,N'-dioleyl adipic amide, and N,N'-dioleyl sebacic amide; aromatic bisamides such as m-xylene bisstearic amide, and N,N'-distearic isophthalic amide; aliphatic metal salts such as calcium stearate, calcium laurate, zinc stearate, and magnesium stearate (generally called metal soap); waxes prepared by grafting aliphatic hydrocarbon wax using vinyl monomer such as styrene and acrylic acid; partially-esterified products of fatty acids and polyhydric alcohols such as behenic acid monoglyceride; methylester compounds having hydroxyl groups, which can be prepared by the hydrogenation of vegetable oils and so on; and long chain alkyl alcohols or long chain alkyl carbonic acids, which have 12 or more carbon atoms.

A particularly preferable mold-releasing agent to be used In the present invention is one of aliphatic hydrocarbon waxes. The aliphatic hydrocarbon waxes include, for example, low molecular weight alkylene polymer obtained by subjecting alkylene to a radical polymerization under high pressure or subjecting alkylene to a polymerization using a Ziegler catalyst under low pressure; alkylene polymer obtained by a thermal decomposition of high molecular weight alkylene polymer; synthesized hydrocarbon wax obtained from the distillation residue of hydrocarbon generated from a synthetic gas containing carbon monoxide and hydrogen using the Arge process, and products obtained from the hydrogenation of the synthesized hydrocarbon wax; and products obtained through fractionation of these aliphatic hydrocarbon waxes using a press sweating process, a solvent method, a vacuum distillation, or a fractional crystallization.

A hydrocarbon as a matrix of the above aliphatic hydrocarbon wax is one synthesized by a reaction between carbon monoxide and hydrogen using a metal oxide catalyst (mostly, used as a multiple system of two or more kinds of catalysts) (e.g., a hydrocarbon compound synthesized by a synthol process, and a hydrocol process (e.g., using a fluid catalyst bed)); hydrocarbons having approximately several hundreds of carbon atoms as an upper limit obtained by the Arge process (using identification catalyst bed), with which a number of wax-like hydrocarbons are obtained; and hydrocarbons prepared by polymerizing alkylene such as ethylene using a Ziegler catalyst. Among these hydrocarbons, a straight hydrocarbon having a long saturated portion with a little branching is preferable in the present invention. In particular, a hydrocarbon synthesized without using polymerization of alkylene is preferred particularly also in terms of its molecular weight distribution.

In the present invention, in terms of the fixability of the toner at low temperature and the high-temperature offset resistance property, it is preferable that the mold-releasing agent be included in the toner particles such that a main endothermic peak is observed in the range of 70 to 140° C. in a DSC curve obtained when the toner particles comprising the mold-releasing agent are measured by a differential scanning calorimeter.

The above entothermic peak temperature can be measured using a high-precision internal combustion input-compensation type differential scanning calorimeter, for example, DSC-7 manufactured by PERKIN ELMER Corp., on the basis of ASTMD3418-82. The temperature at which the above peak is observed can be adjusted using a mold-releasing agent where a melting point, a glass transition point, a polymerization degree, or the like of the agent is appropriately adjusted. Further, in addition to the above peak temperature, the above DSC-7 is applicable to the measurements of temperatures that correspond to thermal physical properties of toner particles or toner-particle materials, such as a glass transition point and a softening point of the binder resin, and a melting point of the wax.

In terms of the fixability and the charge characteristics, it is preferable that 2 to 15 parts by mass of the mold-releasing agent is contained in the toner particles with respect to 100 parts by mass of the binder resin.

The toner of the present invention may include other charge control agent for stabilizing the charge characteristics of the toner as far as it does not inhibit the effects of the present invention. The content of the charge control agent is defined depending on the type of the charge control agent, the physical properties of other constituents of the toner particles, and so on. In general, however, the content of the charge control agent is preferably in the range of 0.1 to 10 parts by mass, more preferably in the range of 0.1 to 5 parts by mass with respect to 100 parts by mass of the binder resin in the toner particles. As an example of the above charge control agent, there are two types of agents known in the art: one of the agents controls the charge characteristics of the toner to negative ones and the other controls the charge characteristics of the toner to positive ones. Depending on the type of the toner and the application thereof, one or more of different kinds of the charge control agents can be used.

Examples of effective charge control agents that control the charge characteristics of the toner to negative ones include organic metal complexes and chelate compounds, such as monoazo metal complexes; acetylacetone metal complexes; and metal complexes or metal salts of aromatic hydroxycarboxylic acid or aromatic dicarboxylic acid. Furthermore, other agents that control the charge characteristics of the toner to negative ones include, for example, aromatic mono- or poly-carboxylic acid, and metal salts and anhydrates thereof; and phenol derivatives such as esters and bisphenols.

Examples of the charge control agents that control the charge characteristics of the toner to positive ones include nigrosine and modified products thereof with fatty acid metal salt or the like; quaternary ammonium salts such as tributylbenzyl ammonium-1-hydroxy-4-naphthosufonate, and tetrabutyl ammonium tetrafluoroborate, and analogues thereof such as onium salts including phosphonium salts and lake pigments thereof; triphenyl methane dyes and lake pigments thereof (laking agents include phosphotungstic acid, phosphomolybdic acid, phosphotungstic molybdic acid, tannic acid, lauric acid, gallic acid, ferricyanic acid, ferrocyanic compounds, and so on); metal salts of higher fatty acids; diorgano tin oxides such as dibutyl tin oxide, dioctyl tin oxide, and dicyclohexyl tin oxide; and diorgano tin borates such as dibutyl tin borate, dioctyl tin borate, and dicyclohexyl tin borate. In the present invention, one or more of these compounds can be used independently or in combination with each other. Among these compounds, as a preferable charge control agent that controls the charge characteristics of the toner to positive ones, the nigrosine compounds, quaternary ammonium salts, or the like are used.

In terms of the developing method, the physical properties of the toner materials, and so on, the toner of the present invention is preferably one having negative charge characteristics.

The toner of the present invention is used such that various kinds of materials are externally added in the above toner particles depending on the type of the toner. Materials to be externally added include a flow improver that improves the fluidity of toner, for example, inorganic fine powders, and external additives such as conductive fine powders that adjust the charge characteristics of toner, for example, metal oxide fine particles, and so on. For example, furthermore, when the toner of the present invention is formulated as a two-component toner, the above external additives and magnetic carriers may be used.

The above flow improver is one that improves the fluidity of the toner when it is externally added in the toner particles. The examples of such a flow improver include fluoride resin powders such as vinylidene fluoride fine powders, and polytetrafluoroethylene fine powders; fine-powdered silica such as wet-process silica and dry-process silica, fine-powdered titanium oxide, and fine-powdered alumina; and processed silica, processed titanium oxide, and processed alumina, obtained by subjecting the fine-powdered silica, fine-powdered titanium oxide, and fine-powdered alumina to surface treatment with a silane coupling agent, a titanium coupling agent, silicone oil, and so on, respectively.

The flow improver preferably has a specific surface area of 30 $m^2/g$ or more, more preferably of 50 $m^2/g$ or more, which is measured by a BET method with a nitrogen adsorption. The content of the flow improver varies depending on the type thereof, but for example, the flow improver is blended at a concentration preferably of 0.01 to 8 parts by mass, more preferably of 0.1 to 4 parts by mass with respect to 100 parts by mass of the toner particles.

A preferable flow improver is fine powders generated by a vapor-phase oxidation of silicon halide and generally referred to as dry-process silica or fumed silica. Such a kind of silica may be prepared, for example by the use thermal decomposition and oxidation reactions of silicon tetrachloride gas in oxygen and hydrogen atmosphere. The underling reaction formula is represented as follows.

$$SiCl_4+2H_2+O_2 \rightarrow SiO_2+4HCl$$

In this manufacturing process, for example, by using silicon halide together with other metal halide such as aluminum chloride or titanium chloride, it is possible to obtain complex fine powders between silica and other metal oxide. Therefore, these fine powders are also included in the silica fine powders to be used as a flow improver in the present invention. The particle size of the silica fine powders is preferably in the range of 0.001 to 2 $\mu$m, more preferably in the range of 0.002 to 0.2 $\mu$m as an average primary particle size.

Commercially-available silica fine powders generated by the vapor-phase oxidation of silicon halide include those in the marketplace in the trade names, for example, of AEROSIL 130, 200, 300, 380, TT600, MOX170, MOX80, and COK84 (manufactured by NIPPON AEROGEL Co., Ltd.); Ca-O-SiL M-5, MS-7, MS-75, HS-5, and EH-5 (manufactured by CABOT Co., Ltd.); Wacker HDKN 20 V15, N20E, T30, and T40 (manufactured by WACKHER-CHEMIE GMBH Co., Ltd.); D-C Fine SiliCa (manufactured by DOW CORNING Co., Ltd.); and Fransol (manufactured by FRANSIL Co., Ltd.).

In the present invention, it Is preferable to subject the above silica fine powders to hydrophobic treatment. In addition, for expressing the physical properties of the toner stable even in environmental variations, it is particularly preferable to treat the silica fine powders such that the hydrophobic degree of the silica fine powders measured by a methanol titration test is in the range of 30 to 80 degrees. Here, the above hydrophobic degree is based on the quantity of methanol in a liquid mixture of water and methanol at the time of completing the sedimentation of silica fine powders caused by dropping methanol into the predetermined amount of silica fine powders being stirred in water, which is represented in percentage.

As a method of providing silica fine powders with hydrophobic properties, for example, there is a method by which silica fine particles are chemically treated with one of organic silicon compounds or silicone oil which can be reacted with the silica fine powders or can physically adsorb on the silica fine particles. The hydrophobic treatment with organic silicon compound is more preferable.

The above organic silicon compounds include hexamethyl disilazane, trimethyl silane, trimethyl chlorosilane, trimethyl ethoxysilane, dimethyl dichlorosilane, methyl trichlorosilane, allyl dimethylchlorosilane, allyl phenyldichlorosilane, benzyl dimethylchlorosilane, bromomethyl dimethylchlorosilane, a-chloroethyl trichlorosilane, B-chloroethyl trichlorosilane, chloromethyl dimethyl chlorosilane, triorganosilyl mercaptan, trimethylsilyl mercaptan, triorganosilyl acrylate, vinyldimethyl acetoxysilane, dimethylethoxy silane, dimethyldimethoxy silane, diphenyldiethoxy silane, hexamethyl disiloxane, 1,3-divinyltetramethyl disiloxane, 1,3-diphenyltetramethyl disiloxane, and dimethylpolysiloxane having 2 to 12 siloxane units per molecule and having a hydroxyl group bonded to Si at a unit located on the terminal. One or more of these compounds are used independently or in combination with each other.

In the process of providing the silica fine powders with hydrophobic properties, among the above organic silicon compounds, one or more of silane coupling agents having nitrogen atoms may be used. Such nitrogen-containing silane coupling agents include, for example, aminopropyl trimethoxysilane, aminopropyl triethoxysilane, dimethylaminopropyl trimethoxysilane, diethylaminopropyl trimethoxysilane, dipropylaminopropyl trimethoxysilane, dibutylaminopropyl trimethoxysilane, monobutylaminopropyl trimethoxysilane, dioctylaminopropyl dimethoxysilane, dibutylaminopropyl dimethoxysilane, dibutylaminopropyl monomethoxysilane, dimethylaminophenyl triethoxysilane, trimethoxysilyl-γ-propylphenylamine, and trimethoxysilyl-γ-propylbenzylamine.

In the present invention, furthermore, a preferable silane coupling agent is hexamethyl disilazane (HMDS).

Furthermore, silicone oil to be preferably used in the process of making the silica fine powders hydrophobic has a viscosity preferably of 0.5 to 10,000 centistokes, more preferably of 1 to 1,000 centistokes, and still more preferably of 10 to 200 centistokes at 25° C. Particularly preferable silicone oil includes, for example, dimethyl silicone oil, methylphenyl silicone oil, a-methylstyrene-denatured silicone oil, chlorophenyl silicone oil, and fluorine-denatured silicone oil.

As a method of making the surface of silica fine powders hydrophobic in which silicone oil is used, for example, one of the following methods can be used. That is, a method of directly mixing the silica fine powders treated with a silane coupling agent and the silicone oil by a mixer such as a Henschel mixer; a method of spraying silicone oil on silica fine powders to be provided as a base; a method of dissolving or dispersing silicone oil in an appropriate solvent, adding silica fine powders and mixing, and removing the solvent; and so on.

In the case of making the surface of the silica fine powders hydrophobic with silicone oil, the silica fine powders are more preferably heated at 200° C. or more (more preferably 250° C. or more) in inert gas after the treatment with silicone oil to stabilize the coating on the surface of the silica fine powders.

In the present invention, it is possible to use both the silane coupling agent and the silicone oil described above for providing the surface of the silica fine powders with hydrophobic properties. As a method of making the surface hydrophobic, for example, the silica fine powders may be previously treated with a silane coupling agent, followed by treatment with silicone oil. Alternatively, as a method of making the surface hydrophobic, the silica fine powders may be treated with both the silane coupling agent and the silicone oil at once, or the like.

The toner of the present invention may be a two-component toner obtained by mixing the above toner particles and carrier particles. For the carrier particles, various kinds of carrier particles heretofore known in the art can be used. For example, the carrier particles to be used are those made of a magnetic material, those made of a magnetic material coated with a resin, those prepared by dispersing a magnetic material in resin particles, or the like.

Furthermore, the current value of carrier particles is preferably in the range of 20 to 200 $\mu$A. The current value of carrier particles can be adjusted with the degree of irregularities of the surface of carrier particles and the amount of the resin to be coated thereon.

The magnetic material to be used for the carrier particles is a material that contains an element such as iron, cobalt, nickel, aluminum, copper, lead, magnesium, tin, zinc, antimony, beryllium, bismuth, cadmium, calcium, manganese, selenium, titanium, tungsten, or vanadium. Examples of such a magnetic material include oxides such as ferrite, iron-excess type ferrite, magnetite, and $\gamma$-iron oxide, metals such as iron, cobalt, and nickel, and alloys thereof.

Examples of the resin to be used in the carrier particles include styrene-acrylate copolymer, styrene-methacrylate copolymer, acrylate copolymer, methacrylate copolymer, silicone resin, fluorine-containing resin, polyamide resin, ionomer resin, polyphenylene sulfide resin, and mixtures thereof.

The method of manufacturing the toner of the present invention is not specifically limited. Typically, the toner of the present Invention may be prepared by sufficiently mixing the above binder resin, the colorant, the sulfur-containing resin, and optionally other additives by a mixer such as a Henschel mixer or a ball mill, melting the resulting mixture by a thermal kneading machine such as a kneader or an extruder, kneading and milling the melted mixture to dissolve the resins in the mixture with each other, solidifying the melted and kneaded product with cooling, followed by pulverizing the solidified product, classifying the pulverized products to obtain toner particles, and sufficiently mixing the toner particles and external additives such as a flow improver by a mixture such as a Henschel mixer as needed.

Furthermore, for manufacturing the toner of the present invention, the classification is performed at any time after the generation of toner particles. For instance, the classification may be performed after mixing with the external additive. Furthermore, appropriate mechanical or thermal impact is applied on the toner particles thus generated to adjust the toner particles into appropriate shape (more specifically spherical shape).

In the method of manufacturing the toner, the method of pulverizing the above solidified product is preferably one that applies a mechanical impact on such a product. The process of applying such a mechanical impact is one, for example, using a mechanical pulverizer such as a pulverizer, KTM (manufactured by KAWASAKI HEAVY INDUSTRIES, Ltd.) or a turbo mill (manufactured by TURBO KOGYO CO., LTD.), or using a device such as a mechano-fusion system (manufactured by HOSOKAWA MICRON CORPORATION) or a hybridization system (manufactured by NARA MACHINERY Co., Ltd.). These devices may be used without any modification or may be used with appropriate modifications.

In the following description, a toner manufacturing device described below is one typically used in the art. However, the manufacturing device for the toner of the present invention is not limited to such a device.

TABLE 1

Examples of Pulverizing Devices for Manufacturing Toner

| Name of Device | Manufacturer |
|---|---|
| COUNTER JET MILL | HOSOKAWAMICRON CORPORATION |
| MICRON JET | HOSOKAWAMICRON CORPORATION |
| IDS TYPE MILL | Nippon Pneumatic Mfg. Co., Ltd. |
| PJM JET PULVERIZER | Nippon Pneumatic Mfg. Co., Ltd. |
| CROSS JET MILL | KURIMOTO,LTD. |
| ULMAX | NISSO ENGINEERING CO., LTD. |
| SK JET-O-MILL | Seishin Enterprise Co., Ltd. |
| KRYPTRON | Kawasaki Heavy Industries, Ltd. |
| TURBO MILL | TURBO KOGYO CO., LTD. |
| INOMIZER | HOSOKAWAMICRON CORPORATION |

TABLE 2

Examples of Classifying Devices for Manufacturing Toner

| Name of Device | Manufacturer |
|---|---|
| CLASSIEL | Seishin Enterprise Co., Ltd. |
| MICRON CLASSIFIER | Seishin Enterprise Co., Ltd. |
| SPEDIC CLASSIFIER | Seishin Enterprise Co., Ltd. |
| TURBO CLASSIFIER | Nisshin Engineering Inc. |
| MICRON SEPARATOR | HOSOKAWAMICRON CORPORATION |
| TURBOPLEX (ATP) | HOSOKAWAMICRON CORPORATION |
| TSP SEPARATOR | HOSOKAWAMICRON CORPORATION |
| ELBOW JET | Nittetsu Mining Co., Ltd. |
| DISPERSION SEPARATOR | Nippon Pneumatic Mfg. Co., Ltd. |
| YM MICROCUT | Yasukawa Shoji Limited |

TABLE 3

Examples of Sieving Devices for Manufacturing Toner

| Name of Device | Manufacturer |
|---|---|
| ULTRASONIC | Koei Sangyo Co., Ltd. |
| REZONA SIEVE | TOKUJU CO., LTD. |
| VIBRASONIC SYSTEM | DALTON Corporation |
| SONICLEEN | SINTOKOGYO, LTD. |
| GYROSIFTER | TOKUJU Co., LTD. |
| CIRCULAR OSCILLATION SIEVE | Plural Makers |
| TURBO SCREENER | TURBO KOGYO CO., LTD. |
| MICROSHIFTER | Makino Mfg. Co., Ltd. |

TABLE 4

Examples of Mixing Devices for Manufacturing Toner

| Name of Device | Manufacturer |
|---|---|
| HENSHEL MIXER | MITSUI MINING COMPANY, LIMITED |
| SUPER MIXER | KAWATA Mfg. Co., Ltd. |
| RIBOCONE | OKAWARA MFG. CO., LTD., |
| NAUTA MIXER | HOSOKAWAMICRON CORPORATION |
| SPIRAL PIN MIXER | Pacific Machinery & Engineering Co., Ltd |
| LOEDIGE MIXER | MATSUBO Corporation |

TABLE 4-continued

Examples of Mixing Devices for Manufacturing Toner

| Name of Device | Manufacturer |
|---|---|
| TURBULIZER | HOSOKAWAMICRON CORPORATION |
| CYCLOMIX | HOSOKAWAMICRON CORPORATION |

TABLE 5

Examples of Kneading Devices for Manufacturing Toner

| Name of Device | Manufacturer |
|---|---|
| KRC KNEADER | KURIMOTO, LTD. |
| BUSS KO-KNEADER | Buss |
| TEM TYPE EXTRUDER | TOSHIBA MACHINE CO., LTD. |
| TEX TWIN-SCREW KNEADER | Japan Steel Works Co., Ltd. |
| PCM KNEADER | IKEGAI LTD. |
| THREE-ROLL MILL | INOUE MANUFACTURING CO., LTD. |
| MIXING ROLL MILL | INOUE MANUFACTURING CO., LTD. |
| KNEADER | INOUE MANUFACTURING CO., LTD. |
| KNEADEX | MITSUI MINING COMPANY, LIMITED |
| MS TYPE PRESSURE KNEADER | MORIYAMA MANUFACRUTING CO., LTD. |
| KEADER-RUDER | MORIYAMA MANUFACRUTING CO., LTD. |
| BANBURY MIXER | KOBE STEEL, LTD. |

The physical properties of the toner of the present invention can be measured by the well-known method. Hereinafter, a description will be given of preferred measuring methods and preferable procedures for the measurements in the present invention. The measured values in examples described later are obtained by the following methods.

(i) Method of Extracting IPA-Insoluble Components in Toner Particles and Sulfur-containing Resin In 100 ml of isopropyl alcohol (IPA), 10 g of toner or sulfur-containing resin was dissolved and was then stirred for 4 hours, followed by filtrating, desolvating, and drying to extract IPA-insoluble components, (ii) Method of Calculating $I_S/T_S$ and $IB_S/B_S$ A measurement sample of each of toner particles, sulfur-containing resin, the IPA-insoluble components in the toner particles, is press-molded by a sample press-molding machine. The resulting measurement sample is subjected to a measurement using a fluorescent X-ray analyzer such as SYSTEM 3080 (manufactured by RIGAKU INDUSTRIAL CORPORATION) to detect a peak intensity of S element in each samples followed by calculating the intensity ratio thereof.

(iii) Measurement of Molecular Weight Distribution of the Sulfur-containing Resin The weight average molecular weight of the sulfur-containing resin can be obtained by measuring the molecular weight distribution of the sample by a gel-permeation chromatography (GPC) and calculating the weight average molecular weight of the sample using the number of counts being measured and the analytical curve of an appropriate reference material.

More specifically, in the measuring method, a column is stabilized In a heat chamber at 40° C., and tetrahydrofuran (THF) is used as a solvent and is then caused to flow into the column at a flow rate of 1 ml per minute. The column is preferably a combination of plural commercially-available polystyrene-gel columns, for example, a combination of μ-styragel 500, 103, 104, and 105 (manufactured by WATERS Co., Ltd.) or a combination of shodex KA-801, 802, 803, 804, 805, 806, and 807 (manufactured by SHOWA DENKO K.K.).

After solving the sample in THF, the sample is filtrated through a 0.2-μm filter, and the filtrate is then used as a measurement sample. The THF sample solution of the resin is adjusted so as to be 0.05 to 0.6% by weight of resin as concentration of the resulting sample. The THF sample solution is poured by 50 μl to 200 μl into the column for the measurement. As a detector, a refractive index (RI) detector is used.

For measuring the molecular weight of the sample, the molecular weight distribution of the sample is calculated on the basis of the relationship between the logarithmic value of an analytical curve prepared using several kinds of monodisperse polystyrene standard samples and the number of counts obtained by the measurement.

The standard polystyrene samples for preparing the analytical curve may include, for example, at least about 10 standard polystyrene samples having their respective molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, manufactured by PRESSURE CHEMICAL Co., Ltd. or TOYO SODA MANUFACTURING CO., LTD.

EXAMPLES

Hereinafter, the present invention will be described with reference to examples. However, the present invention is not limited to these examples.

Manufacturing Examples of Sulfur-Containing Resin (Manufacturing Example 1)

| | |
|---|---|
| Methylethylketone | 60 g |
| Isopropyl alcohol | 140 g |
| Water | 200 g |
| Styrene | 468 g |
| 2-etylhexyl acrylate | 96 g |
| 2-acrylamide-2-methylpropane sulfonic acid | 48 g |
| Lauroyl peroxide | 3 g |

The above raw materials were put in a flask. Then, a stirring apparatus, a thermometer, and a nitrogen introducing apparatus were attached on the flask, followed by subjecting the mixture to a solution polymerization at 80° C. under nitrogen atmosphere. The polymerization proceeded up to a predetermined viscosity. After that, the temperature was increased to 120° C., and the polymerized mixture was desolvated, dried under reduced pressure, and pulverized, resulting in a sulfur-containing resin (a) having a weight average molecular weight of 27,000 and a glass-transition temperature of 72° C. The ratio ($IB_S/B_S$) of the content of sulfur of the IPA-insoluble components to the content of sulfur in the resin was 0.75. The manufacturing conditions of the sulfur-containing resin and the physical properties of the resin manufactured are listed in Table 6.

Manufacturing Examples 2 to 4

Hereinafter, as shown in Table 6, sulfur-containing resins (b) to (d) were obtained by changing the solvent, the type of monomer, and the amount of monomer. The conditions for manufacturing the sulfur-containing resin and the physical properties of the resins being manufactured are listed in Table 6.

| (Comparative Manufacturing Example 1) | |
|---|---|
| Methylethylketone | 160 g |
| Isopropyl alcohol | 120 g |
| Water | 120 g |
| Styrene | 480 g |
| 2-etylhexyl acrylate | 108 g |

-continued

| (Comparative Manufacturing Example 1) | |
|---|---|
| 2-acrylamide-2-methylpropane sulfonic acid | 12 g |
| Lauroyl peroxide | 4 g |

The above raw materials were put in a flask. Then, a stirring apparatus, a thermometer, and a nitrogen introducing apparatus were attached on the flask, followed by subjecting the mixture to a solution polymerization at 80° C. under nitrogen atmosphere. The polymerization proceeded up to a predetermined viscosity. After that, the temperature was increased to 120° C., and the polymerized mixture was desolvated, dried under reduced pressure, and pulverized, resulting in a sulfur-containing resin (e) having a weight average molecular weight of 24,000 and a glass-transition temperature of 66° C. The ratio between the content of sulfur in the resin and the content of sulfur in the IPA-insoluble components was 0.98. The manufacturing conditions of the sulfur-containing resin and the physical properties of the resin manufactured are listed in Table 6.

Comparative Manufacturing Example 2

Hereinafter, as shown in Table 6, comparative sulfur-containing resin (f) to (I) were obtained by changing the solvent, the type of monomer, and the amount of monomer. The conditions for manufacturing the sulfur-containing resin and the physical properties of the resins being manufactured are listed in Table 6.

TABLE 6

Manufacturing Examples of Sulfur-containing Resin

| | | Solvent Configuration | | | | | | Monomer Configuration | | | | | | |
|---|---|---|---|---|---|---|---|---|---|---|---|---|---|---|
| | Resin No. | Water | MEK | IPA | methanol | toluene | xylene | St | Acrylic monomer | Sulfur-containing Monomer | Mw | Tg (° C.) | IPA-soluble components (mass %) | BIs/Is |
| Manufacturing Example 1 | a | 200 g | 60 g | 140 g | — | — | — | 468 g | 2-EHA 96 g | 48 g | 27000 | 72 | 25 | 0.75 |
| Manufacturing Example 2 | b | 200 g | 40 g | 160 g | — | — | — | 432 g | BA 108 g | 60 g | 39000 | 68 | 24 | 0.62 |
| Manufacturing Example 3 | c | 180 g | 70 g | 150 g | — | — | — | 482 g | 2-EHA 100 g | 18 g | 12000 | 60 | 40 | 0.91 |
| Manufacturing Example 4 | d | 200 g | 30 g | 170 g | — | — | — | 486 g | BA 84 g | 30 g | 46000 | 78 | 18 | 0.53 |
| Comparative Manufacturing Example 1 | e | 120 g | 160 g | 120 g | — | — | — | 480 g | 2-EHA 108 g | 12 g | 24000 | 66 | 29 | 0.98 |
| Comparative Manufacturing Example 2 | f | 240 g | 10 g | 150 g | — | — | — | 430 g | BA 90 g | 72 g | 48000 | 79 | 16 | 0.43 |
| Comparative Manufacturing Example 3 | g | — | — | 50 g | — | 350 g | — | 426 g | BA 156 g | 18 g | 34000 | 48 | 46 | 0.36 |
| Comparative Manufacturing Example 4 | h | — | — | — | 300 g | 100 g | — | 468 g | 2-EHA 96 g | 48 g | 11000 | 64 | 8 | 0.99 |
| Comparative Manufacturing Example 5 | i | — | — | — | 50 g | — | 350 g | 540 g | — | — | 60 g | 13000 | 98 | 30 0.45 |

2-EHA: 2-etylhexyl acrylate, BA: butyl acrylate, sulfur-containing monomer: 2-acrylamide-2-methylpropane sulfonic acid Manufacturing Examples of Toner

| (Manufacturing Example 1) | |
|---|---|
| Polyester resin (Condensation polymer of bisphenol A propylene oxide addition product, bisphenol A ethylene oxide addition product, terephthalic acid, succinic acid derivative, and trimellitic acid, glass transition temperature: 60° C., softening point: 140° C., and acid number: 18 mg KOH/g) | 100 parts by mass |
| Magnetic iron oxide (Average particle size: 0.18 μm, Hc: 9.6 kA/m, ss: 81 $Am^2/kg$, and sr: 13 $Am^2/kg$). | 90 parts by mass |
| Sulfur-containing resin (a) | 3 parts by mass |
| Polyethylene wax (melting point: 105° C.) | 5 parts by mass |

The above mixture was melted and kneaded by a biaxial extruder heated at 130° C., the mixture being melted and kneaded was cooled down, and the cooled mixture was roughly pulverized with a hammer mill. The roughly pulverized product was finely pulverized by a turbo mill (manufactured by TURBO KOGYO CO., LTD.), and the resulting finely-pulverized product was then classified by an air-classifier, resulting in a magnetic toner having a weight average particle size of 7.8 μm.

In 100 parts by mass of the toner, 1.0 part by mass of hydrophobic dry-process silica (BET 180 $m^2/g$) was externally added and mixed by a Henschel mixer to obtain a toner (1-1). In addition, 1.0 part by mass of hydrophobic oil-treated silica (BET 150 $m^2/g$) was externally added in 100 parts by mass of the toner and mixed by a Henschel mixer to obtain a toner (1-2). In each of these toners, the content of IPA-soluble components is 0.4%, and the ratio ($I_S/T_S$) between the content of sulfur in the toner and the content of sulfur in the IPA-insoluble components was 0.76. The type and the blending amount of the used resin and the physical properties of the toner are listed in Table 7.

| (Manufacturing Example 2) | |
|---|---|
| Hybrid resin (Bisphenol A propylene oxide addition product, bisphenol A ethylene oxide addition product, terephthalic acid, succinic acid derivative, trimellitic acid, styrene, 2-ethylhexyl acrylate, and acrylic acid; glass transition temperature: 58° C., softening point: 130° C., and acid number: 12 mg KOH/g) | 100 parts by mass |
| Magnetic iron oxide (Average particle size: 0.18 μm, Hc: 9.6 kA/m, ss: 81 $Am^2/kg$, and sr: 13 $Am^2/kg$). | 90 parts by mass |
| Sulfur-containing resin (b) | 5 parts by mass |
| Polyethylene wax (melting point: 105° C.) | 5 parts by mass |

Toners (2-1) and (2-2) were obtained under the same conditions as those of Manufacturing Example 1, except that the above mixture was used. The type and the blending amount of the used resin and the physical properties of the toner are listed in Table 7.

Manufacturing Example 3

Toners (3-1) and (3-2) were obtained under the same conditions as those of Manufacturing Example 1, except that the sulfur-containing resin (c) was used instead of the sulfur-containing resin (a) and the addition amount thereof was changed to 10 parts by mass. The type and the blending amount of the used resin and the physical properties of the toner are listed in Table 7.

| (Manufacturing Example 4) | |
|---|---|
| Styrene/2-ethylhexyl acrylate copolymer | 100 parts by mass |
| Magnetic iron oxide (Average particle size: 0.18 μm, Hc: 9.6 kA/m, ss: 81 $Am^2/kg$, and sr: 13 $Am^2/kg$). | 90 parts by mass |
| Sulfur-containing resin (d) | 2 parts by mass |
| Polyethylene wax (melting point: 105° C.) | 5 parts by mass |

Toners (4-1) and (4-2) were obtained under the same conditions as those of Manufacturing Example 1, except that the above mixture was used. The type and the blending amount of the used resin and the physical properties of the toner are listed in Table 7.

Comparative Manufacturing Example 1

Toners (5-1) and (5-2) were obtained under the same conditions as those of Manufacturing Example 1, except that the sulfur-containing resin (e) was used and the addition amount thereof was changed to 4 parts by mass. The type and the blending amount of the used resin and the physical properties of the toner are listed in Table 7.

Comparative Manufacturing Example 2

Toners (6-1) and (6-2) were obtained under the same conditions as those of Manufacturing Example 4, except that the sulfur-containing resin (f) was used and the addition amount thereof was changed to 1 part by mass. The type and the blending amount of the used resin and the physical properties of the toner are listed in Table 7

Comparative Manufacturing Example 3

Toners (7-1) and (7-2) were obtained under the same conditions as those of Manufacturing Example 1, except that the sulfur-containing resin (g) was used and the addition amount thereof was changed to 4 part by mass. The type and the blending amount of the used resin and the physical properties of the toner are listed in Table 7.

Comparative Manufacturing Example 4

Toners (8-1) and (8-2) were obtained under the same conditions as those of Manufacturing Example 4, except that the sulfur-containing resin (h) was used. The type and the blending amount of the used resin and the physical properties of the toner are listed in Table 7.

Comparative Manufacturing Example 5

Toners (9-1) and (9-2) were obtained under the same conditions as those of Manufacturing Example 1, except that the sulfur-containing resin (i) was used and the addition amount thereof was changed to 1 part by mass. The type and the blending amount of the used resin and the physical properties of the toner are listed in Table 7.

TABLE 7

| Manufacturing Examples of Toner | | | | | |
|---|---|---|---|---|---|
| | | Sulfur-containing resin | | IPA-soluble components | |
| | Binder resin | Resin No. | Amount | (mass %) | Is/Ts |
| Manufacturing Example 1 | Polyester | (a) | 3 | 0.4 | 0.76 |
| Manufacturing Example 2 | Hybrid | (b) | 5 | 0.6 | 0.64 |
| Manufacturing Example 3 | Polyester | (c) | 10 | 2.1 | 0.93 |
| Manufacturing Example 4 | Styrene acryl | (d) | 2 | 0.2 | 0.54 |
| Comparative Manufacturing Example 1 | Polyester | (e) | 4 | 0.5 | 0.98 |
| Comparative Manufacturing Example 2 | Styrene acryl | (f) | 1 | 0.1 | 0.45 |
| Comparative Manufacturing Example 3 | Polyester | (g) | 4 | 0.9 | 0.32 |
| Comparative Manufacturing Example 4 | Styrene acryl | (h) | 2 | 0.1 | 0.99 |
| Comparative Manufacturing Example 5 | Polyester | (i) | 1 | 0.2 | 0.48 |

Evaluation of Durability of Toner

Example 1

A commercially-available digital copier (IR6000, manufactured by CANON Inc.) was reconstructed such that the processing speed was increased from 265 mm/second to 320 mm/second Thus, the digital copier having the output speed of 70 prints per minute was obtained and used with the toner (1-1) under normal-temperature and low-humidity conditions (temperature: 23° C. and humidity: 5%) and under high-temperature and high-humidity conditions (temperature: 30° C. and humidity: 80%) to continuously print 1,000,000 copies for evaluating the durability, respectively.

In addition, a commercially-available digital copier (GP215, manufactured by CANON Inc.) having the output speed of 21 prints per minute was used with the toner (1-2) of the present invention under normal-temperature and low-humidity conditions (temperature: 23° C. and humidity: 5%) and under high-temperature and high-humidity conditions (temperature: 30° C. and humidity: 80%) to continuously print 500,000 copies for evaluating the durability, respectively.

In the evaluation of durability using each of the above digital copiers, a chart having an image ratio of 5% was used as an original. The evaluation results of the IR6000 reconstructed copier are listed in Table 8, while the evaluation results of the GP215 are shown in Table 9. The image evaluation was performed as follows.

1. Image Density

The image density was measured using a Macbeth densitometer (manufactured by MACBETH Co., Ltd.) with an SPI filter. That is, the reflection density of a 5-mm circle with a density of 1.1 on the copied paper was measured before and after the durability test.

2. Fog

The amount of fog formed on an image was evaluated by measuring a transfer material before the image formation and a white background after the formation of the image by a reflection densitometer (reflect meter model TC-6DS, manufactured by TOKYO DENSHOKU Co., Ltd.) Then, the value of (Ds)−(Dr) was calculated, where Ds(%) represents a worst value (maximum value) of the reflection density after the image formation on the white background and Dr (%) represents an average reflection density of the transfer material before the image formation. The value was defined as the amount of fog for the evaluation. The measurements were conducted at the initial stage of the durability test and after the durability test. The fog was evaluated on the basis of the following criteria:

A. the amount of fog is less than 1%;

B. the amount of fog is in the range of 1.0 to 2.0%;

C. the amount of fog is in the range of 2.0 to 3.0%; and

D. the amount of fog is more than 3.0%.

3. Sharpness of Digital Image (Image Quality)

An original containing characters and lines was used. An image formed at the beginning of the durability test and an image formed after the durability test were visually observed, or magnified and observed using a microscope. The sharpness of the digital image was evaluated on the basis of the following criteria:

A. a character image and a line image are both reproduced faithfully in detail;

B. a few irregularities of the image and a little scattering of toner are found in detail, but this leads to no problem in visual observation;

C. the irregularities of the image and the scattering of toner can be recognized by visual observation; and D. the image on the original cannot be reproduced as the significant irregularities of the image and the significant scattering of toner are caused.

Examples 2 to 4

Using the respective toners (2-1) to (4-1), and (2-2) to (4-2), the same evaluations as those of Example 1 were conducted. Consequently, the results as shown in Tables 8 and 9 were obtained. The evaluation results of the IR6000 reconstructed copier are listed in Table 8, and the evaluation results of the GP215 are listed in Table 9.

Comparative Examples 1 to 5

Using the respective toners (5-1) to (9-1), and (5-2) to (9-2), the same evaluations as those of Example 1 were conducted. Consequently, the results as shown in Tables 8 and 9 were obtained. The evaluation results of the IR6000 reconstructed copier are listed in Table 8, and the evaluation results of the GP215 are listed in Table 9.

TABLE 8

Evaluation of Durability of Toner (Evaluation with the IR6000 reconstructed copier)

| | Evaluation under surrounding conditions at 23° C. and 5 RH % | | | | | | Evaluation under surrounding conditions at 30° C. and 80 RH % | | | | | |
|---|---|---|---|---|---|---|---|---|---|---|---|---|
| | Beginning | | | After durability test through 1,000,000 copies | | | Beginning | | | After durability test through 1,000,000 copies | | |
| | Density | Fog | Image quality | Density | Fog | Image quality | Density | Fog | Image quality | Density | Fog | Image quality |
| Example 1 | 1.45 | A | A | 1.44 | A | A | 1.42 | A | B | 1.41 | B | B |
| Example 2 | 1.44 | B | A | 1.43 | B | B | 1.43 | B | B | 1.42 | B | B |
| Example 3 | 1.41 | B | B | 1.39 | C | B | 1.4 | B | B | 1.38 | B | C |
| Example 4 | 1.42 | B | A | 1.39 | C | A | 1.4 | B | B | 1.38 | C | B |
| Comparative Example 1 | 1.35 | B | C | 1.3 | C | C | 1.29 | C | C | 1.27 | C | D |
| Comparative Example 2 | 1.38 | C | B | 1.34 | D | C | 1.36 | C | C | 1.32 | C | C |
| Comparative Example 3 | 1.31 | B | C | 1.24 | D | C | 1.41 | A | A | 1.36 | C | C |
| Comparative Example 4 | 1.37 | C | B | 1.3 | D | C | 1.39 | B | B | 1.33 | B | C |
| Comparative Example 5 | 1.27 | C | C | 1.23 | D | D | 1.4 | B | B | 1.32 | C | C |

TABLE 9

Evaluation of Durability of Toner (Evaluation with the GP215)

| | Evaluation under surrounding conditions at 23° C. and 5 RH % | | | | | | Evaluation under surrounding conditions at 30° C. and 80 RH % | | | | | |
|---|---|---|---|---|---|---|---|---|---|---|---|---|
| | Beginning | | | After durability test through 1,000,000 copies | | | Beginning | | | After durability test through 1,000,000 copies | | |
| | Density | Fog | Image quality | Density | Fog | Image quality | Density | Fog | Image quality | Density | Fog | Image quality |
| Example 1 | 1.42 | A | B | 1.42 | A | B | 1.41 | A | A | 1.4 | A | B |
| Example 2 | 1.42 | A | B | 1.41 | B | B | 1.4 | A | B | 1.39 | A | B |
| Example 3 | 1.4 | B | B | 1.37 | B | B | 1.39 | B | B | 1.36 | B | C |
| Example 4 | 1.38 | B | A | 1.34 | C | B | 1.37 | B | B | 1.33 | B | C |
| Comparative Example 1 | 1.33 | C | C | 1.29 | C | C | 1.28 | B | C | 1.22 | B | C |
| Comparative Example 2 | 1.35 | C | C | 1.31 | D | C | 1.32 | B | C | 1.29 | C | D |
| Comparative Example 3 | 1.34 | B | C | 1.24 | C | D | 1.38 | B | A | 1.33 | C | C |
| Comparative Example 4 | 1.4 | C | B | 1.3 | D | C | 1.36 | B | B | 1.3 | B | C |
| Comparative Example 5 | 1.33 | C | C | 1.23 | D | D | 1.39 | B | B | 1.29 | C | D |

What is claimed is:

1. A toner comprising toner particles comprising at least a binder resin, a colorant, and a sulfur-containing resin, wherein the toner particles comprise the sulfur-containing resin so as to satisfy a relation of:

$$0.50 \leqq I_S/T_S \leqq 0.95$$

where $T_S$ denotes a content of sulfur in the toner particles, and $I_S$ denotes a content of sulfur in isopropyl alcohol insoluble components of the toner particles.

2. The toner according to claim 1, wherein the toner particles comprise the sulfur-containing resin so as to satisfy a relation of:

$$0.60 \leqq I_S/T_S \leqq 0.85.$$

3. The toner according to claim 1, wherein the sulfur-containing resin comprises a monomer containing sulfonic acid group as a constituent.

4. The toner according to claim 3, wherein the sulfur-containing resin comprises at least one selected from the group consisting of a styrene monomer and an acrylic monomer as a constituent.

5. The toner according to claim 1, wherein the sulfur-containing resin comprises an acrylamide monomer containing sulfonic acid group as a constituent.

6. The toner according to claim 1, wherein the sulfur-containing resin comprises 2-acrylamide-2-methylpropanesulfonic acid as a constituent.

7. The toner according to claim 1, wherein the toner particles comprise 0.1 to 10% by mass of isopropyl alcohol soluble components.

8. The toner according to claim 1, wherein the sulfur-containing resin satisfies a relation of:

$$0.50 \leqq IB_S/B_S \leqq 0.95$$

where $B_S$ denotes the content of sulfur in the sulfur-containing resin, and $IB_S$ denotes the content of sulfur in isopropyl alcohol insoluble components of the sulfur-containing resin.

9. The toner according to claim 8, wherein the sulfur-containing resin satisfies a relation of:

$$0.60 \leqq IB_S/B_S \leqq 0.85.$$

10. The toner according to claim 1, wherein the sulfur-containing resin has a weight average molecular weight of 5,000 to 50,000.

11. The toner according to claim 1, wherein the sulfur-containing resin has a weight average molecular weight of 12,000 to 40,000.

12. The toner according to claim 1, wherein the toner comprises the sulfur-containing resin by 0.2 to 10 parts by mass with respect to 100 parts by mass of the binder resin.

13. The toner according to claim 1, wherein the toner has a negative charge characteristic.

14. The toner according to claim 1, wherein the colorant comprises magnetic iron oxide, and a content of the colorant is 20 to 150 parts by mass with respect to 100 parts by mass of the binder resin.

* * * * *